US011674732B2

(12) United States Patent
Tomoharu et al.

(10) Patent No.: US 11,674,732 B2
(45) Date of Patent: Jun. 13, 2023

(54) REFRIGERATOR

(71) Applicant: Samsung Electronics Co., Ltd, Suwon-si (KR)

(72) Inventors: Iwamoto Tomoharu, Kanagawa (JP); Matsuno Tomohiko, Kanagawa (JP); Shibuya Makoto, Kanagawa (JP); Seo Tatsuya, Kanagawa (JP); Aoki Ryota, Kanagawa (JP); Takase Hitoshi, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/557,889

(22) Filed: Aug. 30, 2019

(65) Prior Publication Data

US 2020/0072526 A1 Mar. 5, 2020

(30) Foreign Application Priority Data

Aug. 31, 2018 (JP) ..... 2018-162562
May 24, 2019 (KR) ..... 10-2019-0061140

(51) Int. Cl.
*F25D 11/02* (2006.01)
*F25D 23/00* (2006.01)

(52) U.S. Cl.
CPC ..... *F25D 11/022* (2013.01); *F25D 23/006* (2013.01)

(58) Field of Classification Search
CPC ..... F25B 40/00; F25D 11/022; F25D 23/006
See application file for complete search history.

(56) References Cited

U.S. PATENT DOCUMENTS 2,342,566 A 2/1944 Wolfert
3,128,607 A 4/1964 Kyle
(Continued)

FOREIGN PATENT DOCUMENTS

CN 103090602 A 5/2013
DE 60113072 T2 6/2006
(Continued)

OTHER PUBLICATIONS

ISA/KR, International Search Report, International Application No. PCT/KR2019/010437, dated Dec. 18, 2019, 3 pages.
(Continued)

*Primary Examiner* — Tavia Sullens

(57) ABSTRACT

Disclosed herein is a refrigerator including a cooling cycle mechanism having improved cooling cycle efficiency by more effectively performing heat exchange between a refrigerant discharged from an evaporator and a refrigerant discharged from a condenser. The refrigerator includes a cooling cycle mechanism including a compressor, a condenser, and an evaporator. The refrigerator also includes a first pipe configured including a first heat exchanger and configured to guide the refrigerant from the condenser, to the evaporator. The refrigerator further includes a second pipe including a heat exchanger and configured to guide the refrigerant from the evaporator, to the compressor. The second heat exchanger is adjacent to first heat exchanger and configured to exchange heat with the first heat exchanger. The first heat exchanger and the second heat exchanger are arranged to guide the refrigerant in a same direction.

20 Claims, 7 Drawing Sheets

(56) References Cited

U.S. PATENT DOCUMENTS

| | | | | |
|---|---|---|---|---|
| 3,274,797 | A | 9/1966 | Kritzer | |
| 5,406,805 | A * | 4/1995 | Radermacher | F25D 11/022 62/113 |
| 5,765,391 | A * | 6/1998 | Lee | F25B 40/00 62/442 |
| 6,679,321 | B2 * | 1/2004 | Jin | F25B 13/00 62/238.7 |
| 6,945,073 | B2 | 9/2005 | Matsumoto et al. | |
| 2007/0215333 | A1 | 9/2007 | Viklund et al. | |
| 2013/0111943 | A1 * | 5/2013 | Yoon | F25B 40/00 62/498 |
| 2015/0121949 | A1 | 5/2015 | Heo et al. | |
| 2017/0074549 | A1 | 3/2017 | Lilie et al. | |

FOREIGN PATENT DOCUMENTS

| | | | |
|---|---|---|---|
| DE | 102008037819 | A1 | 12/2009 |
| EP | 0485147 | A1 | 5/1992 |
| EP | 3190356 | A1 | 7/2017 |
| GB | 2180921 | A | 4/1987 |
| JP | S61-228276 | A | 10/1986 |
| JP | 2001-280802 | A | 10/2001 |
| JP | 2005195201 | A | 7/2005 |
| JP | 2009085539 | A | 4/2009 |
| KR | 10-1997-0028183 | A | 6/1997 |
| KR | 10-1999-0074486 | A | 10/1999 |
| KR | 10-2004-0020013 | A | 3/2004 |
| KR | 10-2015-0051594 | A | 5/2015 |

OTHER PUBLICATIONS

Supplementary European Search Report dated Jul. 22, 2021, in connection with European Patent Application No. EP19855898.3, 8 pages.

The First Office Action dated Nov. 30, 2021, in connection with Chinese Application No. 201980055235.1, 22 pages.

China National Intellectual Property Administration, "The Second Office Action," dated May 11, 2022, in connection with Chinese Patent Application No. 201980055235.1, 13 pages.

China National Intellectual Property Administration, "The Third Office Action," dated Aug. 9, 2022, in connection with Chinese Patent Application No. 201980055235.1, 19 pages.

* cited by examiner

REFRIGERATOR

CROSS-REFERENCE TO RELATED APPLICATIONS

This application is based on and claims priority under 35 U.S.C. 119 to Korean Patent Application No. 10-2019-0061140 filed on May 24, 2019 in the Korean Intellectual Property Office, which claims the benefit of Japanese Patent Application No. 2018-162562 filed on Aug. 31, 2018 in the Japan Patent Office, the disclosures of which are herein incorporated by reference in their entirety.

BACKGROUND

1. Field

The disclosure relates to a refrigerator.

2. Description of Related Art

Patent JP4238731 B2 discloses a cooling cycle mechanism as a conventional refrigerator. The cooling cycle mechanism is operated in such a way that a capillary tube installed in the middle of a pipe for introducing a refrigerant, which is discharged from a condenser, into an evaporator, and a suction pipe for introducing a refrigerant, which is discharged from the evaporator, into a compressor, are connected in parallel with each other, and thus the refrigerant flowing in the capillary tube exchanges heat with the refrigerant flowing in the suction pipe, thereby improving the efficiency of the cooling cycle.

However, in the refrigerator disclosed in the patent JP4238731 B2, the direction of the refrigerant flowing in the capillary tube and the direction of the refrigerant flowing in the suction pipe are opposite to each other in a contact portion between the capillary tube and the suction pipe. Therefore, in practice, the heat exchange efficiency is only slightly improved, and the efficiency of the cooling cycle is not remarkably improved.

More particularly, the refrigerant flowing in the capillary tube has the highest temperature at the condenser side, and the temperature of the refrigerant is lowered as being away from the condenser. The refrigerant flowing in the suction pipe has the lowest temperature at the evaporator side, and the temperature of the refrigerant is increased as being away from the evaporator.

In the refrigerator disclosed in the patent JP4238731 B2, the heat exchange is performed between a refrigerant having a relatively high temperature on the condenser side of the capillary tube and a refrigerant separated from the evaporator of the suction pipe, and at the same time, the heat exchange is performed between a refrigerant separated from the condenser of the capillary tube and a refrigerant having a relatively high temperature on the evaporator side of the suction pipe, and thus the heat exchange efficiency is only slightly improved.

SUMMARY

Therefore, it is an aspect of the present disclosure to provide a refrigerator including a cooling cycle mechanism having improved cooling cycle efficiency by more effectively performing heat exchange between a refrigerant discharged from an evaporator and a refrigerant discharged from a condenser.

Additional aspects of the present disclosure will be set forth in part in the description which follows and, in part, will be obvious from the description, or may be learned by practice of the present disclosure.

In accordance with an aspect of the disclosure, a refrigerator includes a cooling cycle mechanism configured to circulate a refrigerant into each device including a compressor, a condenser, and an evaporator, a first pipe configured to introduce the refrigerant, which is discharged from the condenser, to the evaporator, and a second pipe configured to introduce the refrigerant, which is discharged from the evaporator, to the compressor, and the first pipe and the second pipe are arranged in parallel with each other, and the first pipe and the second pipe include a heat exchanger in which the refrigerant flowing in the first pipe and the refrigerant flowing in the second pipe perform the parallel flow.

Because refrigerants flowing in both heat exchangers perform the parallel flow, heat exchange is performed between a relatively high temperature refrigerant in the condenser side of the first pipe and a relatively low temperature refrigerant in the evaporate side of the second pipe. Accordingly, the heat exchange efficiency may be greatly improved, and the efficiency of the cooling cycle may be improved.

The heat exchanger of the second pipe may be installed to extend from an end of the evaporator side to the compressor side.

Because heat exchange is performed between the refrigerant flowing in the first pipe and the lowest temperature refrigerant flowing in the second pipe, the heat exchange efficiency may be further improved and the efficiency of the cooling cycle may be improved.

The heat exchanger of the first pipe and the heat exchanger of the second pipe may be arranged as follows. That is, the heat exchanger of the first pipe and the heat exchanger of the second pipe may be arranged in parallel to each other in the vertical direction, and the heat exchanger of the first pipe and the heat exchanger of the second pipe may be arranged in parallel in the horizontal direction. The vertical direction is not limited to a perfectly vertical direction but includes a substantially vertical direction. The horizontal direction is not limited to a perfectly horizontal direction, and includes a substantially horizontal direction.

Because at least one section in which the first pipe intersects the second pipe is provided, the heat exchanger may be formed between the first pipe and the second pipe regardless of the arrangement of the devices constituting the cooling cycle mechanism. Accordingly, heat exchange may be performed between the upstream side in which the refrigerant flowing in the first pipe has a relatively high temperature, and the upstream side in which the refrigerant flowing in the second pipe has a relatively low temperature, thereby improving the heat exchange efficiency of the cooling cycle mechanism. The intersecting position may include a state in which the first pipe and the second pipe intersect with each other while the first pipe and the second pipe are in contact with each other.

The first pipe may include an expander configured to expand the refrigerant, which is discharged from the condenser. In this case, the expander may be a capillary tube constituting at least a part of the first pipe, and the heat exchanger of the first pipe may be constituted by the capillary tube. The expander may be an expansion valve installed in the middle of the first pipe.

The refrigerator may further include an insulating member configured to cover at least a part of both the heat exchangers.

Because both the heat exchangers are arranged inside the insulating member, heat exchange is more efficiently performed between the refrigerants flowing in both the heat exchangers. An outer wall of the refrigerator housing body may be used as the insulating member.

The insulating member may cover at least the upstream side of both the heat exchangers, and the insulating member may further cover a portion other than both the heat exchangers in the first pipe and the second pipe.

The heat exchanger may be arranged between a machine room in which at least one of the compressor and the condenser is placed and a cooling room in which the evaporator is placed. The heat exchanger of the first pipe may be arranged on the machine room side, and the heat exchanger of the second pipe may be arranged on the cooling room side.

The heat exchanger of the first pipe in which a high temperature refrigerant flows may be arranged on the machine room side in which a device that becomes hot is placed, and the heat exchanger of the second pipe in which a low temperature refrigerant flows may be arranged on the cooling room side in which a device that becomes cold is placed. Accordingly, the heat exchange rate in the heat exchanger may be improved.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 6B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The disclosure will be described more fully hereinafter with reference to the accompanying drawings.

A refrigerator 100 according to an embodiment is mainly used in general households. However, the disclosure is applicable not only to a domestic refrigerator but also to a commercial refrigerator. In addition, the refrigerator according to an embodiment includes not only a refrigerator provided with a refrigerating compartment and a freezing compartment but also a refrigerator provided with only refrigerating compartment or a refrigerator provided with only freezing compartment.

Embodiment

Figure 1:
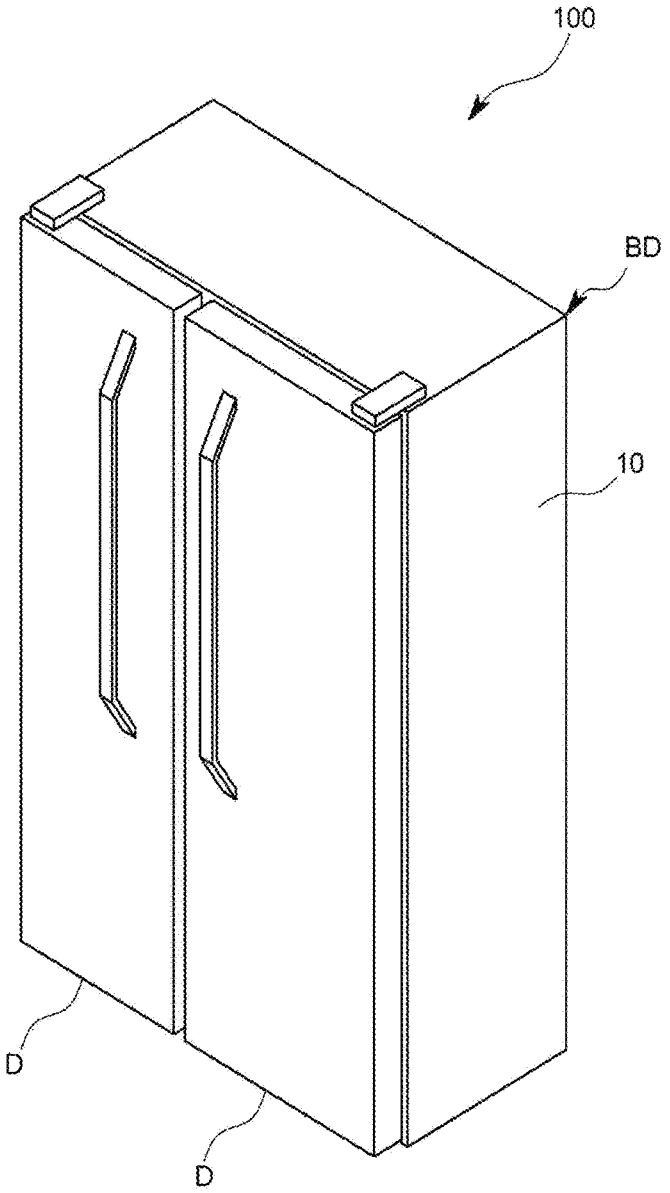
FIG. 1 illustrates a perspective view of a refrigerator according to an embodiment of the disclosure.
Figure 2:
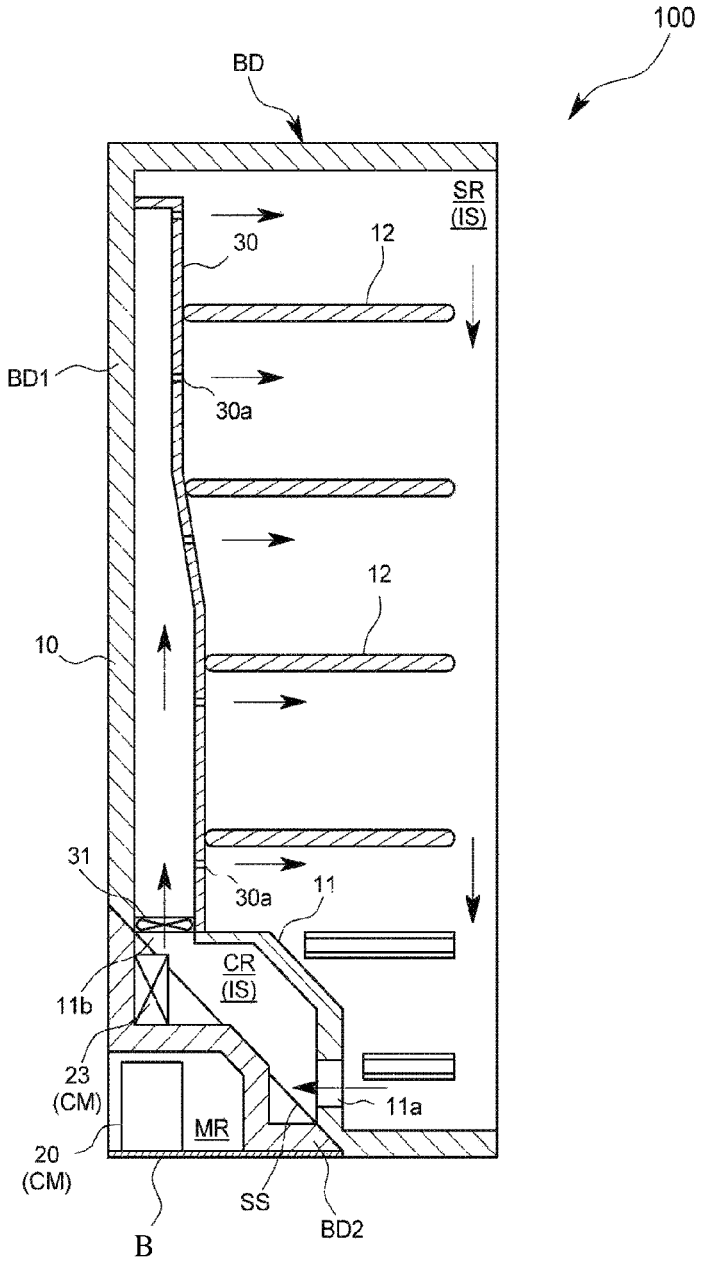
FIG. 2 illustrates a cross-sectional view of a state in which a second housing body element (cooling unit) is connected to a first housing body element of the refrigerator according to an embodiment of the disclosure.

As illustrated in FIGS. 1 and 2, the refrigerator 100 according to an embodiment includes a refrigerator housing body (BD) forming an inner space (IS) and a cooling cycle mechanism (CM) provided with each device configured to cool the inner space IS. Further, the cooling cycle mechanism CM according to an embodiment includes a compressor 20, a blowing fan 21, a condenser 22 and two evaporators 23, which are corresponding to each device.

The refrigerator housing body BD is formed in such a way that opposite side surfaces, a back surface (rear surface), a ceiling surface, and a bottom surface thereof is surrounded by an outer wall 10 and a front surface (forward surface) thereof is opened. A pair of doors (D) is installed in the refrigerator housing body BD through a hinge to close the opening. In addition, the refrigerator housing body BD is divided into two housing body elements (BD1 and BD2) along a predetermined separate surface (SS), as illustrated in FIG. 2. Particularly, the refrigerator housing body BD is divided into the two housing body elements BD1 and BD2 along a tilted separate surface SS extending from the back surface (rear surface) to the bottom surface.

Therefore, the two housing body elements BD1 and BD2 are all formed by an insulating member ("insulation") forming the outer wall 10 of the refrigerator housing body BD. More particularly, the two housing body elements BD1 and BD2 are formed by an insulating member that is formed by foaming an insulating material such as urethane resin in a casing material generally used as the outer wall 10 of the refrigerator housing body BD.

Figure 3:
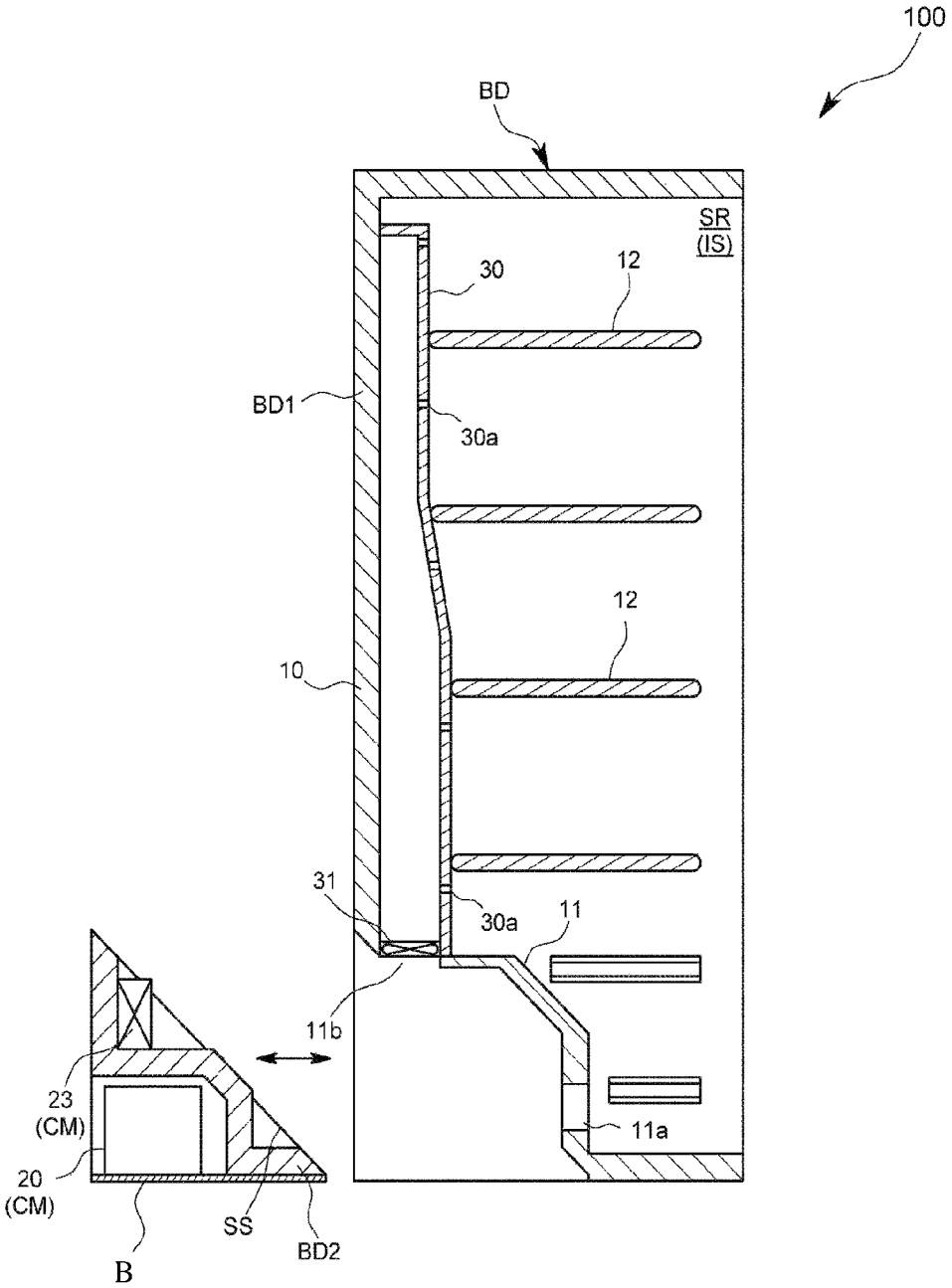
FIG. 3 illustrates a cross-sectional view of a state in which the second housing body element (cooling unit) is not connected to the first housing body element of the refrigerator according to an embodiment of the disclosure.

Between the two housing body elements BD1 and BD2, one side housing body element B1 (hereinafter referred to as "first housing body element BD1") occupies a main portion of the inner space IS and arranged in the front side about the separate surface SS, as illustrated in FIGS. 2 and 3. Further, in the first housing body element BD1, a partition 11 configured to divide the inner space IS into the front side and the separate surface SS side is installed inside the inner space IS. In the first housing body element BD1, a storage room (SR) configured to be opened and closed by one pair of doors D is placed in the front side of the partition 11, and a part of a re-cooling room (CR) configured to re-cool gas cooling the storage room SR is formed in the separate surface SS side of the partition 11. Although not shown, the first housing body element BD1 according to an embodiment is provided with a partition configured to divide the storage room SR and the re-cooling room CR into the left and the right to separate the storage room SR and the re-cooling room CR for refrigerating and freezing.

In the storage room SR, a plurality of shelves 12 are provided on the upper side, and a plurality of drawers (not shown) are provided on the lower side. The partition 11 is provided with an inlet 11*a* introducing gas from the storage room SR to the re-cooling room CR along the bottom surface, and an outlet 11*b* delivering the gas from the cooling room CR to the storage room SR along the back surface. The first housing body element BD1 is provided with a duct 30 extending from the outlet 11*b* provided in the partition 11 to the storage room SR. The duct 30 is provided with a wind inlet 30*a* installed in accordance with a height of each shelf 12 or the drawer, and a fan 31 is installed around the outlet 11*b* of the partition 11.

Between the two housing body elements BD1 and BD2, the other side housing body element B2 (hereinafter referred to as "second housing body element BD2"), is connected to the first housing body element BD1 to form the re-cooling room CR together with the first housing body element BD1. Further, the second housing body element BD2 forms a machine room (MR) at the outer space of the refrigerator and the machine room MR receives the compressor 20, the blowing fan 21 and the condenser 22. The second housing body element BD2 is provided with two evaporators 23 on the inner space forming the re-cooling room CR. The second housing body element BD2 and the cooling cycle mechanism CM are both installed on a support board (B) together with a control box (CB) to constitute the cooling unit. Thus, the second housing body element BD2 may be detachably connected to the first housing body element BD1 as the cooling unit.

When the first housing body element BD1 and the second housing body element BD2 are connected to each other, the storage room SR and the re-cooling room CR are formed in the inner space, and the machine room MR is formed in the outer space. Among the devices constituting the cooling cycle mechanism CM, the evaporator 23 is placed in the re-cooling room CR in the inner space, and the compressor 20, the blowing fan 21 and the condenser 22 are placed in the machine room MR in the outer space. In addition, according to an embodiment, when the first housing body element BD1 and the second housing body element BD2 are connected, the re-cooling room CR is partitioned into the left and right, and the evaporator 23 is respectively positioned in one re-cooling room CR for refrigerating and one re-cooling room CR for freezing. That is, one of the two evaporators 23 serves as a refrigerating evaporator 23*a*, and the other serves as a freezing evaporator 23*b*.

Figure 5:
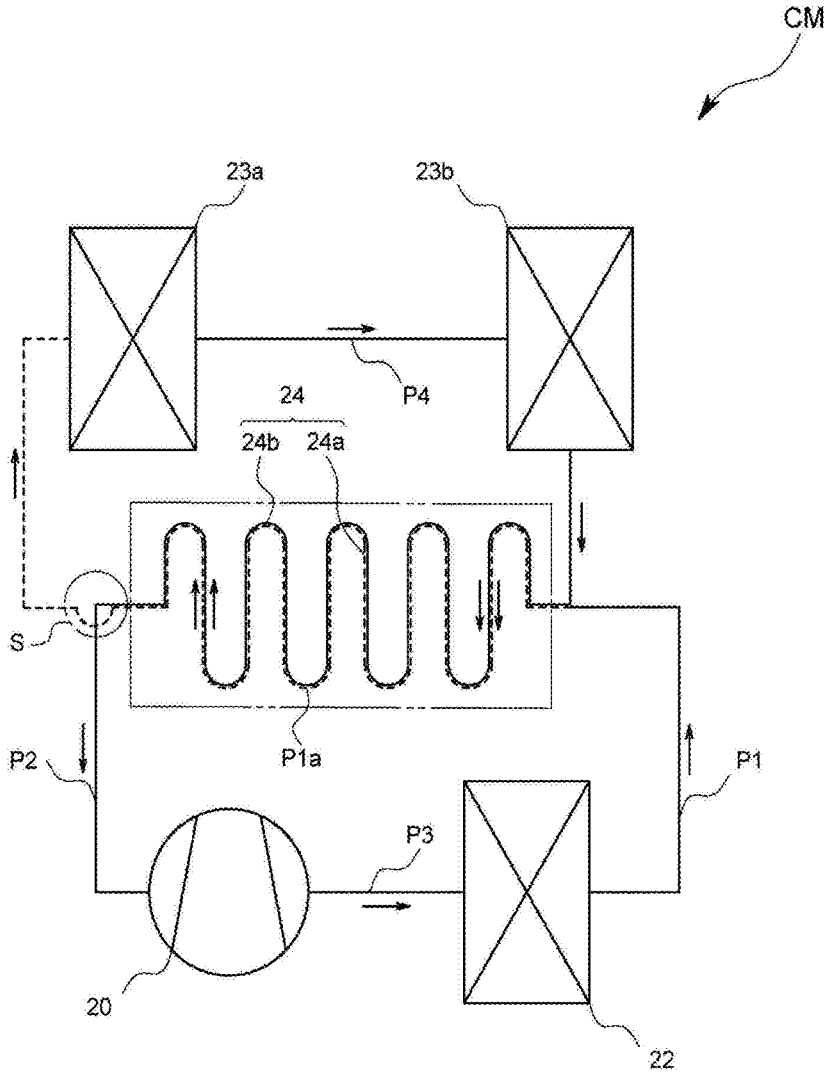
FIG. 5 illustrates a schematic diagram of a cooling cycle according to an embodiment of the disclosure.

Further, as illustrated in FIG. 5, each device constituting the cooling cycle mechanism CM is connected by a plurality of pipe 5, and each device is configured to circulate the refrigerant in the pipe. Particularly, the devices arranged on the machine room MR side are connected the devices arranged on the re-cooling room CR side through a first pipe P1 introducing the refrigerant, which is discharged from the condenser 22, into the refrigerating evaporator 23*a* and a second pipe P2 introducing the refrigerant, which is discharged from the freezing evaporator 23*b*, into the compressor 20. Further, devices arranged on the machine room MR side are connected to each other through a third pipe P3 introducing the refrigerant, which is discharged from the compressor 20, to the condenser 22, and devices arranged on the re-cooling room CR side are connected to each other through a fourth pipe P4 introducing the refrigerant, which is discharged from the refrigerating evaporator 23*a*, to the freezing evaporator 23*b*. Accordingly, the compressor 20, the condenser 22, and the two evaporators 23*a* and 23*b* constituting the cooling cycle mechanism CM are connected to each other through each pipe and thus the refrigerant is circulated through each of these devices.

Further, the first pipe P1 is provided with an expander P1*a* configured to expand a refrigerant, which is flowing in the first pipe P1, before the refrigerant flows into the refrigerating evaporator 23*a*. According to an embodiment, the expander P1*a* corresponds to a capillary tube (indicated by a dotted line in FIG. 4) forming a part of the first pipe P1. The capillary tube according to an embodiment constitutes the downstream side of the first pipe P1.

In addition, the first pipe P1 and the second pipe P2 are arranged to have a section (S) which is a part intersecting on the downstream side. The first pipe P1 and the second pipe P2 are provided with heat exchangers 24*a* and 24*b*. The heat exchangers 24*a* and 24*b* are positioned on the upstream side than the intersecting section, and the heat exchanger 24*a* and the heat exchanger 24*b* are arranged in parallel so as to exchange heat between the refrigerant flowing in the first pipe P1 and the refrigerant flowing in the second pipe P2. For example, the heat exchanger 24*a* of the first pipe P1 and the heat exchanger 24*b* of the second pipe P2 are connected to be in parallel with each other (refer to FIG. 6 A). The first pipe P1 and the second pipe P2 according to an embodiment form the heat exchangers 24*a* and 24*b* by connecting the middle of the capillary tube P1*a* constituting the first pipe P1 to an end portion of the evaporator 23*b* side of the second pipe P2.

In addition, both the heat exchangers 24*a* and 24*b* are arranged to allow the refrigerant flowing in the first pipe P1 and the refrigerant flowing in the second pipe P2 to perform the parallel flow. That is, the refrigerant flowing in the heat exchanger 24*a* of the first pipe P1 and the refrigerant flowing in the heat exchanger 24*b* of the second pipe P2 flow in the same direction.

Figure 4:
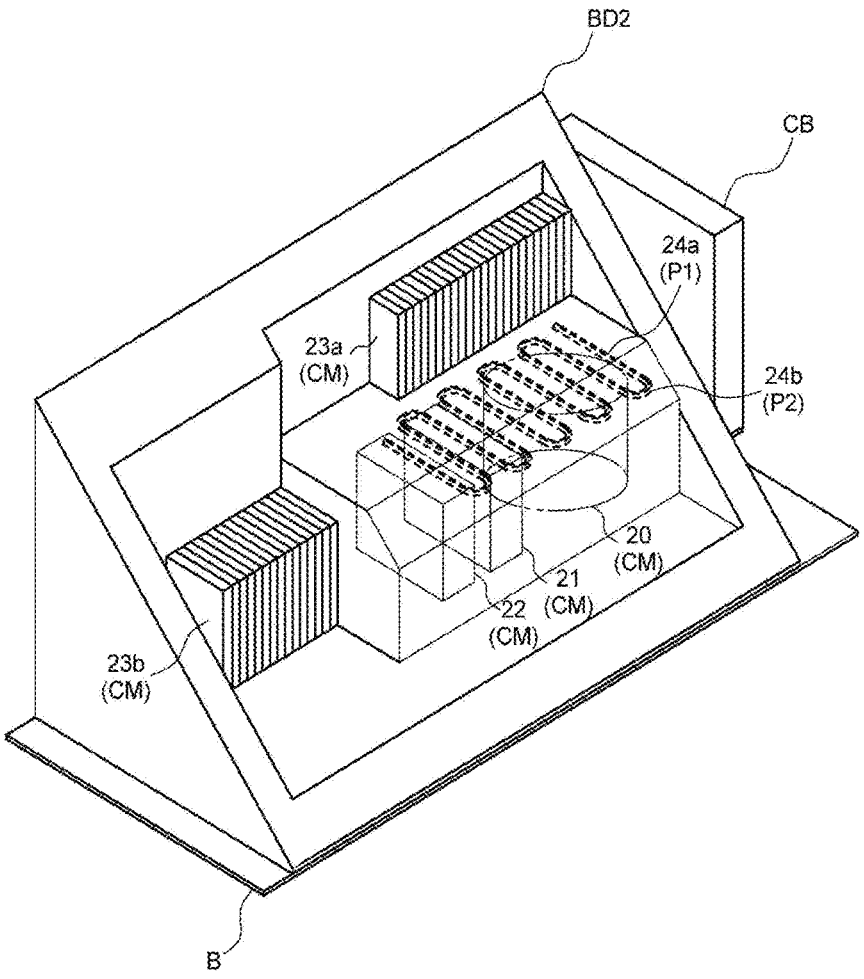
FIG. 4 illustrates a perspective view of the cooling unit according to an embodiment of the disclosure.

Further, as illustrated in FIG. 4, at least a part of the heat exchangers 24*a* and 24*b* is placed in the insulating member constituting the second housing body element BD2. Particularly, the first pipe P1 extends from the machine room MR side to pass through the inside of the second housing body element BD2 and then reach the re-cooling room CR side. The second pipe P2 extends from the re-cooling room CR side to pass through the inside of the second housing body element BD2 and then reach the machine room MR side. A section of the first pipe P1 and the second pipe 2 passing through the inside of the second housing body element BD2 corresponds to the heat exchangers 24*a* and 24*b*. Therefore, both the heat exchangers 24*a* and 24*b* are covered by the insulating member constituting the second housing body element BD2.

As illustrated in FIG. 4, both the heat exchangers 24*a* and 24*b* pass through a section (insulting member) that is separated between the machine room MR and the evaporator 23*a* in the re-cooling room CR in the second housing body element BD2. Both the heat exchangers 24*a* and 24*b* extend in a serpentine manner in the second housing body element BD2. Accordingly, it is possible to secure a distance in a longitudinal direction between the heat exchanger 24*a* of the first pipe P1 and the heat exchanger 24*b* of the second pipe P2 and thus it is possible to secure a sufficient distance for heat exchange. An upstream end of the first pipe P1 constituting the heat exchanger 24*a* extends toward the machine room MR and connected to the condenser 22 and a downstream end thereof extends toward the re-cooling room CR and connected to the refrigerating evaporator 23*a*. An upstream end of the second pipe P2 constituting the heat exchanger 24*b* extends toward the re-cooling room CR and connected to the freezing evaporator 23*b*, and a downstream end thereof extends toward the machine room MR and connected to the compressor 20.

Therefore, the first pipe P1 is configured to cool a high temperature and high pressure liquid refrigerant, which is discharged from the condenser 22, in some degree by using the heat exchanger 24*a* and configured to allow two-phase state of liquid refrigerant and gas refrigerant to flow to the refrigerating evaporator 23*a*. The second pipe P2 is configured to heat a low temperature and low pressure gas refrigerant, which is discharged from the freezing evaporator 23*b*, in some degree by using the heat exchanger 24*b* and configured to allow the refrigerant to flow to the compressor 20. Accordingly, it is possible to efficiently use heat generated by the first pipe P1 and the second pipe P2, thereby improving the efficiency of the cooling cycle.

Figure 6A:
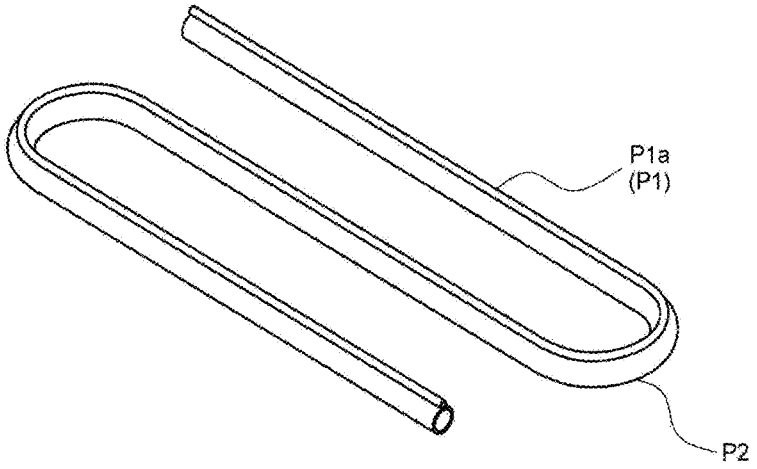
FIGS. 6A and 6B illustrate schematic diagrams of a heat exchanger of a first pipe and a second pipe according to an embodiment of the disclosure.
Figure 6B:
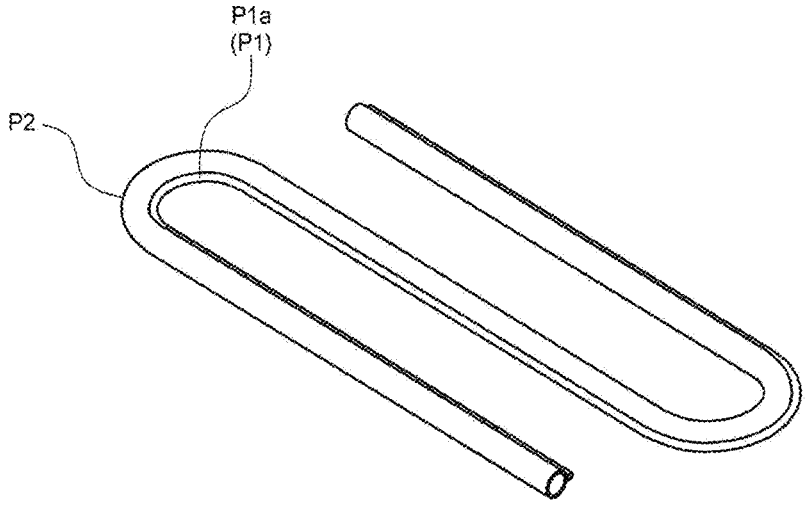

In addition, as illustrated in FIG. 6A, the heat exchanger 24*a* of the first pipe P1 is arranged in the machine room MR side, and the heat exchanger 24*b* of the second pipe P2 is arranged in the re-cooling room CR side. In other words, the heat exchanger 24*a* of the first pipe P1 and the heat exchanger 24*b* of the second pipe P2 are arranged in the vertical direction with respect to each other. As illustrated in FIG. 6B, the heat exchanger 24*a* of the first pipe P1 and the heat exchanger 24*b* of the second pipe P2 may be arranged in the horizontal direction with respect to each other.

Other Embodiments

In the above embodiment, the capillary tube is used as the expander P1*a* of the first pipe P1, but the disclosure is not limited thereto. Therefore, an expansion valve may be used as the expander P1*a*. In this case, the same heat exchange efficiency may be obtained although either or both of the upstream side and the downstream side of the expansion valve of the first pipe P1 servers as the heat exchanger 24*a*.

In the above embodiment, the heat exchangers 24*a* and 24*b* are formed in the middle between the first pipe P1 and the second pipe P2. However, the heat exchanger 24*b* of the second pipe P2 is formed in an end portion of the evaporator 23 side. In this the case, the coldest refrigerant, which is discharged from the evaporator 23 to the second pipe P2, may be used for heat exchange with the refrigerant flowing in the first pipe P1, thereby further improving the heat exchange efficiency.

However, when employing the above-mentioned configuration, it is required that the first pipe P1 extends from the machine room MR to pass through the second housing body element BD2 and bypasses the re-cooling room CR, and then passes through the inside of the second housing body element BD2 together with the second pipe P2.

In the above embodiment, the first pipe P1 and the second pipe P2 are arranged to have a section S which is a part intersecting on the downstream side. However, the section S on which the first pipe P1 and the second pipe P2 intersect is not limited to the downstream side, and thus the section S may be arranged on the upstream side or the center. That is, the intersecting section S may be arranged in the middle between the first pipe P1 and the second pipe P2 in accordance with the arrangement of the device constituting the cooling cycle mechanism CM (particularly, the arrangement of the compressor 20 and the condenser 22 in the outer space, and the arrangement of the evaporator 23 in the inner space). Alternatively, according to the arrangement of the device constituting the cooling cycle mechanism CM, the heat exchanger 24 may be formed without the section S on which the first pipe P1 and the second pipe P2 intersect.

In the above embodiment, the heat exchanger 24 is formed on one position in the middle between the first pipe P1 and the second pipe P2, but the heat exchanger 24 may be formed intermittently in a plurality of positions.

In the above embodiment, the configuration in which only the heat exchangers 24*a* and 24*b* of the first pipe P1 and the second pipe P2 pass through the inside of the second housing body element BD2, is employed but is not limited thereto. Therefore, a configuration in which other than the heat exchangers 24*a* and 24*b* of the first pipe P1 and the second pipe P2, other part may pass through the inside of the second housing body element BD2 may be employed.

In the above embodiment, the refrigerator is described as a type in which the cooling cycle mechanism CM is detachable from the cooling unit. However, the disclosure may be applicable to a refrigerator in which the cooling cycle mechanism CM is not detachable.

As is apparent from the above description, by using the cooling cycle mechanism of the refrigerator, it may be possible to improve the efficiency of the cooling cycle by effectively exchanging heat between the refrigerant discharged from the evaporator and a refrigerant discharged from the condenser.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a cooling cycle mechanism comprising a compressor, a condenser, and multiple evaporators;

a first pipe configured to guide a refrigerant from the condenser to a first evaporator of the multiple evaporators; and a second pipe configured to guide the refrigerant from a second evaporator of the multiple evaporators to the compressor, wherein the second pipe is:

adjacent to the first pipe, and configured to exchange heat with the first pipe, wherein at least one portion of the first pipe and at least one portion of the second pipe are in direct physical contact with each other and extend in a serpentine manner, wherein the portions of the first and second pipes in contact with each other are disposed adjacent to each other and external to each other in a vertical or horizontal arrangement along a full length of the portions where heat is exchanged, wherein the portion of the first pipe includes a first end and a second end and the portion of the second pipe includes a first end which is in contact with the first end of the first pipe and a second end which is in contact with the second end of the first pipe, and wherein the refrigerant flowing in the first pipe flows in a direction from the first end to the second end, and the refrigerant flowing in the second pipe flows in a direction from the first end to the second end, resulting in a parallel flow arrangement relative to the refrigerant flowing in the first pipe.

2. The refrigerator of claim 1, further comprising:

a machine room including the compressor and the condenser;

a cooling room including at least one of the multiple evaporators; and a housing body element configured to separate the machine room from the cooling room and comprising insulation, wherein at least part of the first pipe and at least a part of the second pipe pass through the insulation.

3. A refrigerator comprising:

a cooling cycle mechanism comprising a compressor, a condenser, and multiple evaporators;

a first pipe configured to guide a refrigerant from the condenser to a first evaporator of the multiple evaporators; and a second pipe configured to guide the refrigerant from a second evaporator of the multiple evaporators to the compressor, wherein a contact portion of the second pipe is in direct physical contact with a contact portion of the first pipe and is configured to exchange heat with the first pipe, wherein the contact portion of the second pipe and the contact portion of the first pipe are disposed adjacent to each other and external to each other in a vertical or horizontal arrangement along a full length of the contact portions where heat is exchanged, wherein at least one portion of the contact portion of the first pipe is bent, wherein at least one portion of the contact portion of the second pipe includes a bent shape corresponding to the at least one portion of the contact portion of the first pipe, wherein the contact portion of the first pipe includes a first end and a second end and the contact portion of the second pipe includes a first end which is in contact with the first end of the contact portion of the first pipe and a second end which is in contact with the second end of the contact portion of the first pipe, and wherein the refrigerant flowing in the first pipe flows in a direction from the first end to the second end, and the refrigerant flowing in the second pipe flows in a direction from the first end to the second end, resulting in a parallel flow arrangement relative to the refrigerant flowing in the first pipe.

4. The refrigerator of claim 3, wherein:

the first pipe is closer to the condenser as compared to the second pipe, and the second pipe is closer to the second evaporator as compared to the first pipe.

5. The refrigerator of claim 3, wherein:

at least a portion of the second pipe other than the contact portion intersects with the first pipe.

6. The refrigerator of claim 3, wherein:

the second pipe is perpendicular to the first pipe or parallel to the first pipe.

7. The refrigerator of claim 3, wherein:

the first pipe comprises an expander configured to expand the refrigerant.

8. The refrigerator of claim 7, wherein:

the expander is arranged to form at least a portion of the first pipe.

9. The refrigerator of claim 8, wherein:

the expander comprises a capillary tube or an expansion valve.

10. The refrigerator of claim 3, further comprising:

a machine room including the compressor and the condenser;

a cooling room including at least one of the multiple evaporators; and a housing body element configured to separate the machine room from the cooling room and comprising insulation, wherein at least a portion of the first pipe and at least a portion of the second pipe pass through the insulation.

11. The refrigerator of claim 10, wherein the insulation is configured to:

surround a part of the first pipe, and surround a part of the second pipe.

12. The refrigerator of claim 10, wherein:

the first pipe is arranged closer to the machine room than the cooling room, and the second pipe is arranged closer to the cooling room than the machine room.

13. The refrigerator of claim 3, further comprising:

a first housing body element including a storage room; and a second housing body element including the cooling cycle mechanism, the second housing body element detachably coupled to the first housing body element.

14. The refrigerator of claim 3, wherein:

the first evaporator is a refrigerating evaporator and the second evaporator is a freezing evaporator connected to the refrigerating evaporator, wherein the first pipe is configured to connect the condenser and the refrigerating evaporator, and the second pipe is configured to connect the freezing evaporator to the compressor.

15. A refrigerator comprising:

a first housing body element configured to form a storage room;

a second housing body element detachably coupled to the first housing body element;

a cooling cycle mechanism arranged in the second housing body element, and comprising a compressor, a condenser, an expander, and multiple evaporators;

a first pipe configured to guide a refrigerant from the condenser to a first evaporator of the multiple evaporators; and a second pipe configured to guide the refrigerant from a second evaporator of the multiple evaporators to the compressor, wherein a portion of the second pipe is in direct physical contact with a portion of the first pipe and is configured to exchange heat with the first pipe, wherein the portions of the first and second pipes in contact with each other are disposed adjacent to each other and external to each other in a vertical or horizontal arrangement along a full length of the portions where heat is exchanged, wherein the portion of the first pipe and the portion of the second pipe extend in a serpentine manner, wherein the portion of the first pipe includes a first end and a second end and the portion of the second pipe includes a first end which is in contact with the first end of the first pipe and a second end which is in contact with the second end of the first pipe, and wherein the refrigerant flowing in the first pipe flows in a direction from the first end to the second end, and the refrigerant flowing in the second pipe flows in a direction from the first end to the second end, resulting in a parallel flow arrangement relative to the refrigerant flowing in the first pipe.

16. The refrigerator of claim 15, wherein:

a second portion of the second pipe intersects with the first pipe.

17. The refrigerator of claim 15, wherein:

the first pipe includes the expander, and the second pipe is arranged adjacent to an outlet of the second evaporator.

18. The refrigerator of claim 15, further comprising:

a machine room arranged in the second housing body element, the machine room including the compressor and the condenser; and a cooling room formed by the first housing body element and the second housing body element, the cooling room including at least one of the multiple evaporators;

wherein the second housing body element is configured to separate the machine room from the cooling room and comprises insulation, and wherein at least a part of the first pipe and at least a part of the second pipe pass through the insulation.

19. The refrigerator of claim 15, wherein:

when the second housing body element is coupled to the first housing body element, the second housing body element forms a cooling room with the first housing body element, and the second pipe is arranged closer to the cooling room than the first pipe.

20. The refrigerator of claim 19, wherein the second housing body element comprises:

a machine room including the compressor and the condenser, and insulation configured to:

separate the machine room from the cooling room, and surround at least a part of the first pipe and at least a part of the second pipe.

* * * * *